United States Patent [19]

Engelhard

[11] 4,189,129

[45] Feb. 19, 1980

[54] APPARATUS FOR PROTECTING PARTS IN HEATING AND COOLING PROCESSING CYCLES THEREOF

[75] Inventor: William E. Engelhard, Owego, N.Y.

[73] Assignee: Owego Heat Treat, Inc., Apalachin, N.Y.

[21] Appl. No.: 944,807

[22] Filed: Sep. 22, 1978

[51] Int. Cl.[2] ..... C21D 1/62

[52] U.S. Cl. ..... 266/251; 266/259; 432/254.1

[58] Field of Search ..... 266/255, 249, 251, 259; 432/254.1, 247, 248, 251

[56] References Cited

U.S. PATENT DOCUMENTS

| | | | |
|---|---|---|---|
| 2,744,745 | 5/1956 | Engelhard | 432/254.1 |
| 2,931,636 | 4/1960 | Engelhard | 266/255 |

*Primary Examiner*—L. Dewayne Rutledge

*Assistant Examiner*—Peter K. Skiff

*Attorney, Agent, or Firm*—Sommers & Sommers

[57] ABSTRACT

The invention provides means for processing novel heat treated parts, eliminating danger of contamination of the parts from contaminating ambient or other air and gases. The invention further assures uniform, maximum efficiency in achieving the special hardening and other characteristics of the parts, without contamination thereof, thus obviating the necessity for any supplementary procedures for elimination of warping and other defects which might otherwise occur. The invention automatically and economically achieves the above recited and other objectives, thus assuring uniformity of desired characteristics, qualities and properties in heat treatment procedures, the operations being performed at or above atmospheric pressure thus preventing vaporization of certain alloying elements in the work and container metals.

4 Claims, 6 Drawing Figures

APPARATUS FOR PROTECTING PARTS IN HEATING AND COOLING PROCESSING CYCLES THEREOF

OBJECTS OF THE INVENTION

A novel method of and apparatus for protection of heat treated work parts made of materials such as iron, ferrous alloys, titanium and other metals and their alloys. Such parts are preheated in a heating station or furnace and transferred therefrom to a cooling station. The invention protects the parts in every step in the heat treatment thereof for special requirements, such as for uniform hardness, softening to relieve stresses and strains and to enable the parts to be machined without warpage and without alteration of the contours and structure of the material. Contamination-free heat treatment of such parts is also important for improved machineability, improved physical, magnetic, sintering, carburizing and other properties such as for brazing, normalizing, annealing, hardening and tempering thereof - expensive and complex procedures. Any slightest trace of ambient contaminating air, moisture or other contaminating gases or vapors finding their way into the heat treating procedures and intruding onto the parts would render them unfit for their intended uses; such contaminated parts would have to be rejected, resulting in substantial losses and delays in production.

The present invention obviates risks and problems such as above stated and provides means whereby, in heat treating procedures, the work will be automatically and efficiently kept clean and clear of contaminating ambient or other gases, from the time the parts are first positioned in the heat treating procedure station, such as a furnace, through the time the parts, having achieved the temperature desired, are transferred to the cooling station, and until the parts have been cooled to room or other desired final temperature.

The invention safeguards the parts in the heat treatment procedures to consistently impart thereto the characteristics and properties desired, avoids the damage and losses which might otherwise occur in such procedures, and safeguards against defects and rejections and ensuing delays in production. The procedures of the invention are uniformly accurate, automatic, efficient and economical.

When metals are to be heated to high temperatures for such processes as hardening, carburizing, tempering, annealing, brazing and sintering, it is always desirable, and frequently necessary, that the gas atmosphere surrounding the work meet exceptionally high purity standards (99.9% or better).

Oxygen and water vapor are the two impurities which it is most desirable to eliminate.

One popular method of doing this is by using vacuum furnaces. Heat treating in vacuum requires quite elaborate and expensive pumping and completely sealed chambers. High vacuum introduces new problems:

(a) Volatization of metals and alloys from work and furnace materials.

(b) Convection heating is not available.

(c) Air and moisture are drawn into the chamber when leaks occur.

It is the purpose of this invention to enable operation at pressures only slightly above atmosphere and to do this using easily fabricated heat resistant alloys in conventional furnaces, without requiring gas-tight fittings or fastenings, and with clearances which readily tolerate the bending and warping associated with high temperature operation.

The purity of the atmosphere is maintained by a flow of pure gas introduced directly into the work chamber. The flow rate is sufficient to sweep out the air and moisture initially present, as well as the occluded gases being released by the work and container metals as heating proceeds. The increased ability of surrounding air and moisture to diffuse through the metal as temperatures increase and into the escaping gas where they come in contact is counteracted by the pure gas passing through the labyrinthian passages.

Since the pressure is higher than atmosphere, cracks, and small openings—inevitable with heat treating containers—enable an outward flow to the atmosphere rather than being a means for contaminating air and moisture to enter.

For economic reasons in carrying out the invention, the flow of pure gas into the work chamber is regulated to the lowest rate necessary to fully protect the work; however, when gas quenching or rapid cooling is called for, as with air or oil hardening Tool Steels, the flow can be increased to blast levels as the entire assembly is removed from the furnace and allowed to cool to ambient atmosphere.

DESCRIPTION OF THE DRAWINGS

Embodiments of the invention are illustrated by way of example in the appended drawings, wherein similar reference characters indicated like parts, and wherein.

DESCRIPTION OF THE INVENTION

Figure 1:
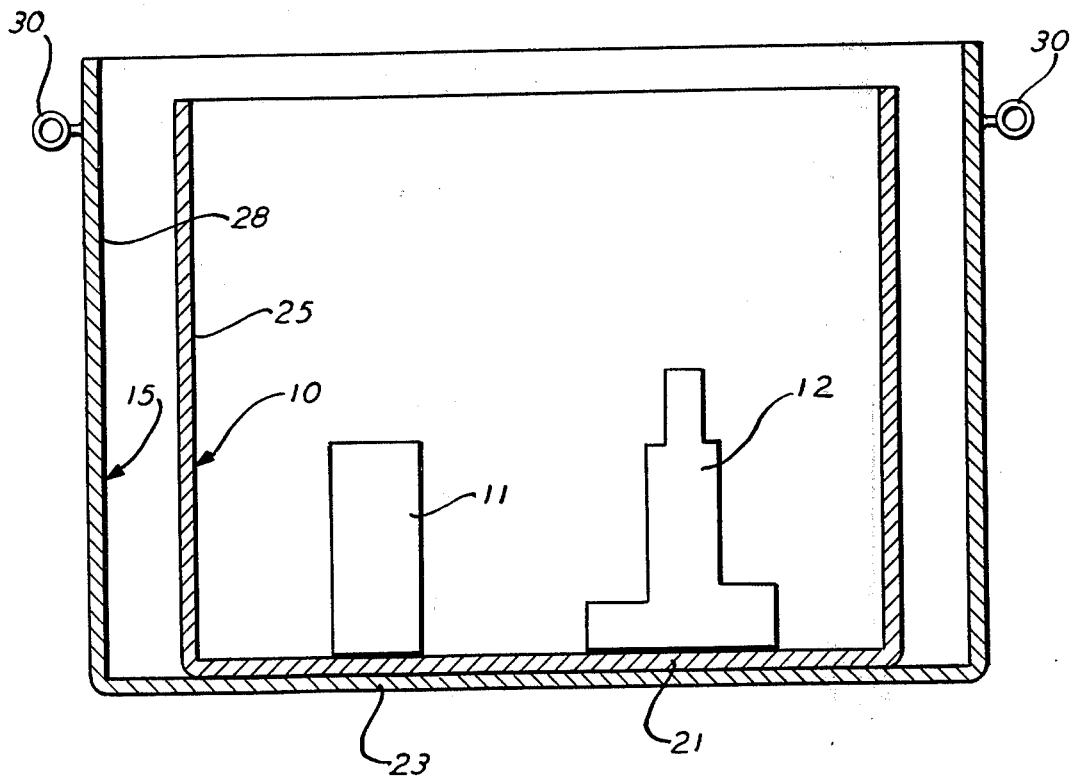
FIG. 1 is a vertical, sectional, elevational view, showing the work holder and work parts positioned within the outermost cup-shaped member pursuant to the method and apparatus of the invention.
Figure 2:
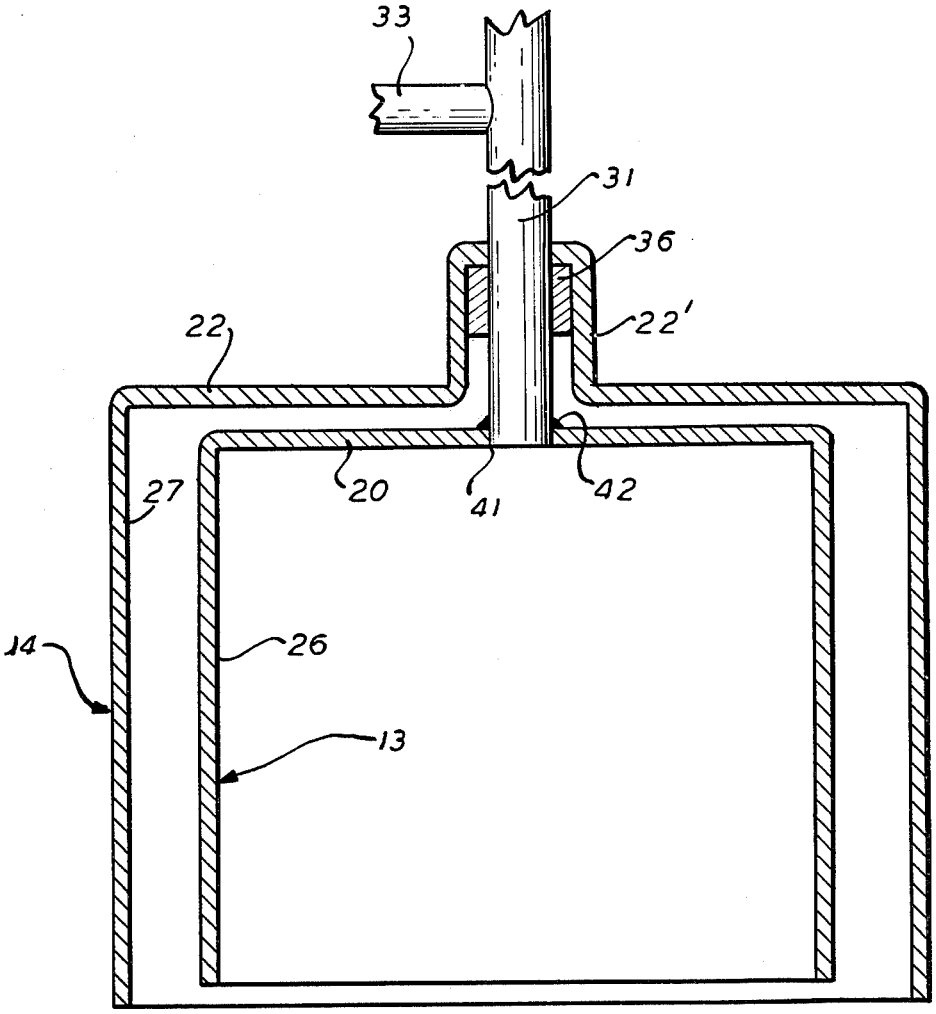
FIG. 2 is a partly fragmentary, vertical, sectional view of inner and outer hood members and associated parts, which may be used in carrying out the invention.

As shown in the drawings, the parts, such as work parts 11, 12 (FIGS. 1 and 4) of various contours and materials, such as, without limitation thereto, of iron or other metals or alloys thereof, to be preheated at a heating station by heat transfer or by heating elements or otherwise, such as in a furnace, to impart the desired temperature to the work for achieving special characteristics, are positioned on or in the work holder 10. The latter is positioned in outermost member 15, which may be provided with elevating and lowering linkage or bracket means 30 which may be coupled to chains, cables, hoists, etc. for vertical reciprocation thereof, as programmed by an operator or automatically. The inner hood member 13 (FIGS. 2–5) has gas supply pipe 31 secured thereto and opening thereinto, as at 41.

Figure 6:
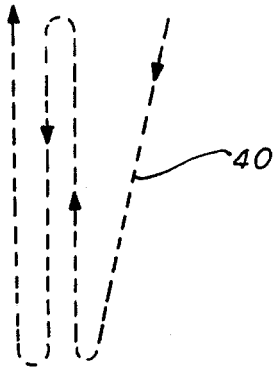
FIG. 6 is a schematic view showing the direct gas flow discharge passageway formed on registration of the members of the invention.

Work protective gas flows under pressure through said tube from a suitable source, such as 33 (FIG. 4) which may be provided with control valves connected to one or more sources for passage of gases, singly or combined, under pressure therethrough and into the work holder and onto the work and through the passageway 40 defined (FIGS. 4, 6) between the outer walls of the work holder 10 and associated and registered members 13, 14, 15.

The outer hood member 14, and associated members 10, 13, 15 may be of circular and generally cup-shaped or other form. The upper end 22' (FIGS. 2, 3, 4) of the bottom wall 22 of outer hood member 14 may be provided with a gasket 36 enabling the outer hood 14 to have relative vertically sealed reciprocation with relation to the gas supply pipe 31, to maintain a continuous flow of gas into hood 13 and holder 10 and parts 11 and 12 at all times, including times of relative movement of parts 13, 14, 15.

A suitable anti-oxidizing, anti-contaminating gas is preferably used as the flushing medium, at a pressure preferably maintained during the heating cycle at the heating station and while transferred therefrom to the cooling station and until the work parts are brought to normal room temperature. The parts are constantly swept by the pure gas flowing through opening 41 and through path 40 (FIGS. 4, 6) pursuant to this invention, driving out oxidizing and other contaminating gases or vapors during and through the pre-heating, the holding, transfer and the cooling cycles.

Figure 4:
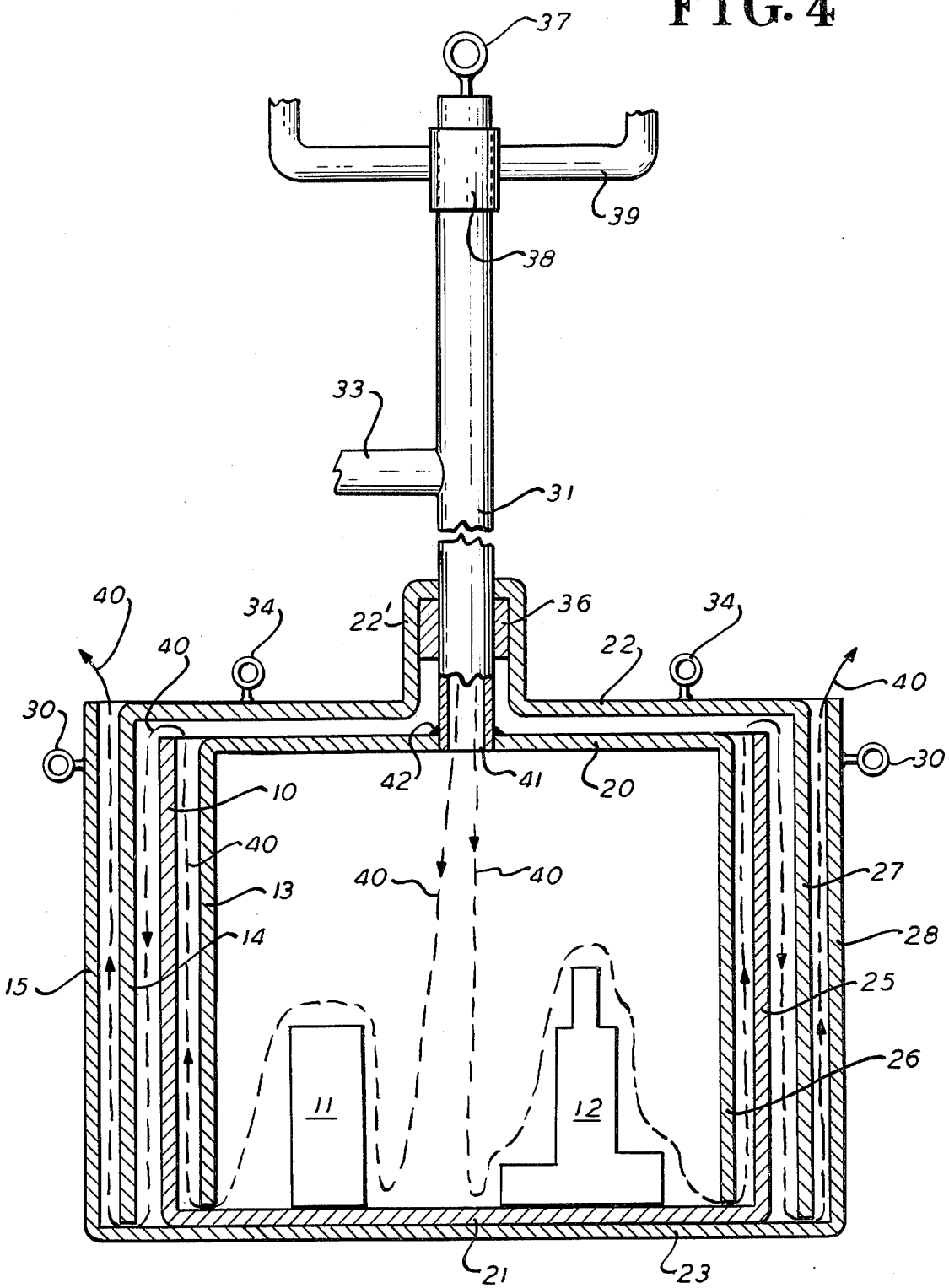
FIG. 4 is a similar view, showing the members so assembled and registered.

The invention, as above described and shown in the drawings, therefore comprises four cup-shaped members, 13, 10, 14, 15, of closely interfitting form and dimensions, namely work holder 10, on which the work 11, 12 may be positioned, an inner hood member 13 of smaller dimensions than the work holder, movable to the position shown in FIG. 4 in covering relation to the interior of the work holder and the work 11, 12 thereon, an outer hood member 14, of larger dimensions than the work holder 10 and movable into relation overlying relation thereto (FIG. 4) on registration of the parts and an outermost member 15, wherein the work holder 10 is (FIG. 1) adapted to be positioned initially pursuant to the invention and which, in the final registration assembly of the parts (FIG. 4) encompasses the other three cup-shaped members.

The following is a schedule, for facility of reference, of the members and their horizontal and vertical walls thereof:

| MEMBERS | HORIZONTAL WALLS | VERTICAL WALLS |
|---|---|---|
| 10 (work holder) | 21 | 25 |
| 13 (inner hood) | 20 | 26 |
| 14 (outer hood) | 22 | 27 |
| 15 (outermost member) | 23 | 28 |

The members 10, 13, 14 and 15 are formed of U-shaped, cup-shaped outline, with side walls, in the example given below, about 26 inches tall. The dimensions of the parts described may be conformed to the uses to which they are to be put, which, in turn may vary from job to job. Thus the side or vertical walls, in some cases, are as much as 84 inches tall, and the horizontal walls 48 inches in diameter. For some work, the side walls may be 26 inches in height (a popular size) but on occasion, depending upon the work at hand being heat treated, and for use on particularly small work, the side walls may, for example, be only 10 inches high, with the bottom walls 14 inches in diameter. The parts 10, 13, 14, 15 are dimensioned to suit the task to be performed, as set forth in examples above recited. For very large work, such as for navy gun barrels and landing gear for aircraft, for example, their dimensions would be correspondingly substantially higher.

The work holder 10, inner and outer hoods 13 and 14 may be formed of 1/32 inch material, with the outermost member 15 of thicker material.

Figure 3:
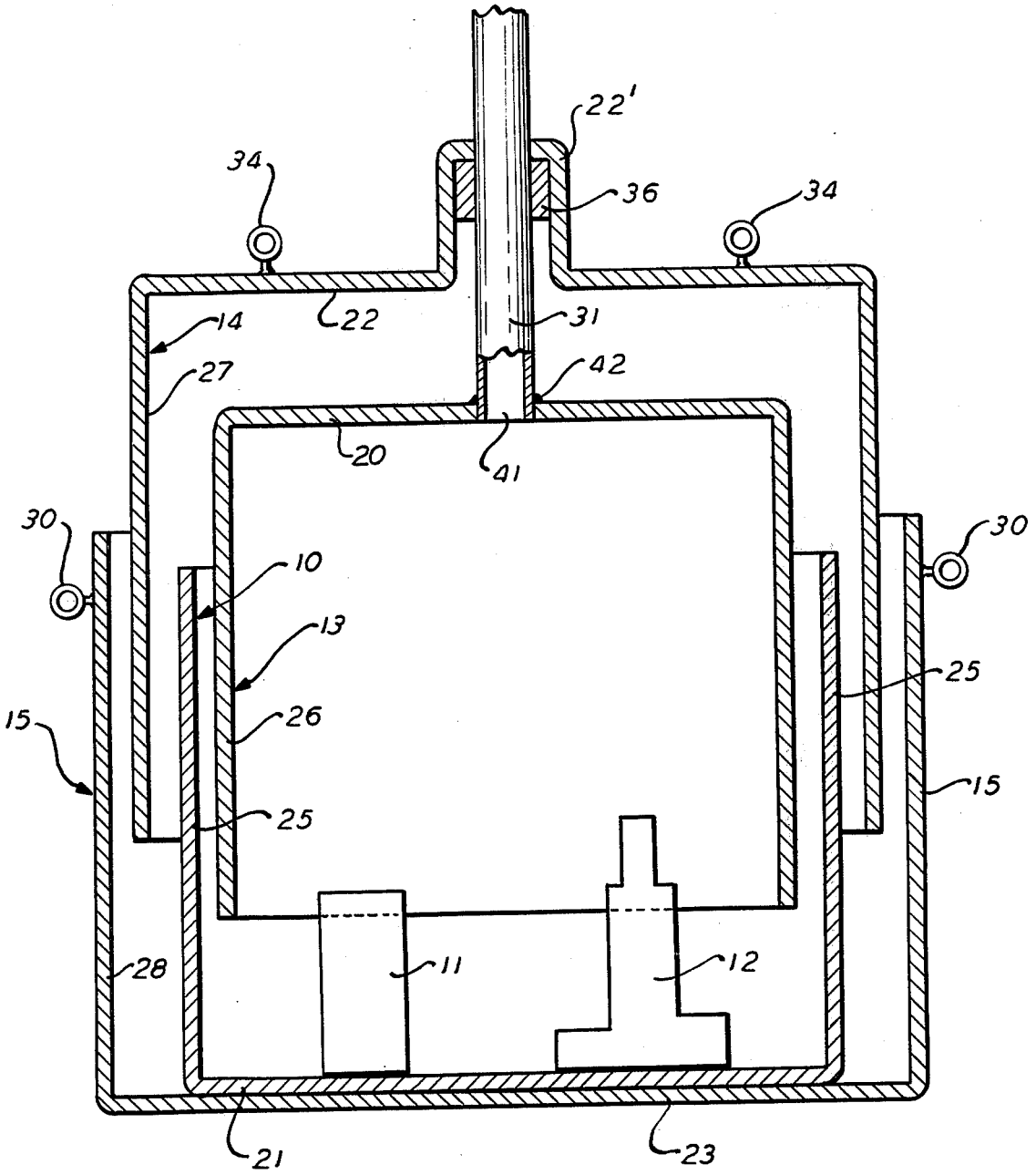
FIG. 3 is a vertical, partly sectional and partly elevational view, showing the members of the apparatus aligned for assembly and registration in accordance with the invention.

The parts are proportioned so that they will telescopically interfit and register, as shown in FIGS. 3 and 4, with a very slight amount (such as $\frac{1}{8}$ to $\frac{1}{4}$ inch) of space between adjacent members—sufficient to enable ready vertical movement of the members with clearance as required, but proportioned so that the passageway defined by their spacing will be a small one, for achieving high velocity of the gas under pressure, pursuant to the invention, to sweep out gases that might otherwise infiltrate or enter into the apparatus and contaminate the parts being treated. The work flushing gas pushes and expels ambient and other impurities which constantly seek to enter the work holder and to contaminate the work by diffusion or otherwise through the work holder and onto the work parts 11, 12. The purified work-flushing gases are pumped from pressure tanks-cylinders or storage tanks by suitable pump means through the gas line (33,31) at preferably about 30 pounds per square inch, with a rate of gas flow adjusted by valve controls, known in the gas adjusting art, set for from 10 to 40 cubic feet of gas flow per hour—a practical example, slightly greater than atmospheric pressure.

The work holder 10, inner hood member 13, outer hood member 14 and outermost member 15 are preferably cylindrical in form and made of materials which satisfactorily withstands the heat treating temperatures to maintain shape without deteriorating or scaling. For example, they may be made of material such as nickel-chrome alloys, *Inconel* 600 being a typical example, and *Nichrome alloy* 33 another.

EXAMPLES OF OPERATION OF THE INVENTION

The invention comprises a process and apparatus for use in the processing of work 11 and 12, such as iron and iron alloys, which has been preheated in a furnace to a predetermined temperature, for example, and without limitation, to a temperature of typically approximately 1800° F. The work may typically be tools or any other parts wherein precision hardening and heat treatment is desirable, pre-heated to a temperature of about 1400° to about 2250° for high speed steel.

The inner hood 13 may be suitably connected to the gas pipe 31 (FIG. 4), and by link or bracket 37 thereon, to a hoist for elevating and lowering and horizontally moving the air supply pipe 31—inner hood 13. Spline or other means 38 (FIG. 4) may further connect the gas pipe 31—inner hood assembly 13 to overhead rail or other means engaging member 39 for moving the assembly horizontally to align the apparatus as in the FIGS. 3, 4 form with a furnace or other heating station, and on completion of the pre-heating thereof, to elevate and transfer the same to a cooling station, which may be in the plant other place wherein the heat treating work is carried out. The bottom wall 22 of the outer hood 14 may be provided with links or suitable brackets such as 34 and the outermost member 15 may be provided with links or brackets 30 for elevating and lowering the work holder 10 and parts 13, 14, 15 and mechanisms (FIGS. 3, 4) in assembling and registering the same and in transferring the same from the pre-heating station to the cooling station.

ASSEMBLY AND REGISTRATION OF THE APPARATUS

Figure 5:
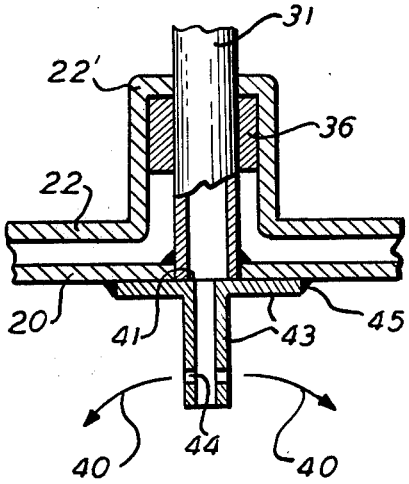
FIG. 5 is a fragmentary, elevational view of a form of the invention wherein direct extensions into the interior of the work holder are provided, for the gas conduit or pipe.

The gas may flow under pressure (FIG. 3) directly through the open lower end 41 of gas pipe 31 and into the inner hood 13 and onto the work parts 11, 12 and thence past the lower end of the inner hood member 13 and between the walls of members 13 and 10, 10 and 14, 14 and 15 and out of the apparatus (FIG. 4). The gas tube 31 may, for example, as shown in FIG. 5, be extended into the inner hood 13, as for example, by sectional pipe 43 secured as by welding or otherwise, to the bottom wall 20 of the inner hood 13, in line with the opening 41 therein.

Pursuant to the invention, work, such as parts 11, 12, FIGS. 1, 3, is positioned on the bottom wall 21 of the work holder 10, which, in turn, is positioned on the bottom wall 23 of the outermost member 15. As above described, the apparatus 10, 13, 14, 15 is proportioned to conveniently complementarily telescopically freely interfit and mesh for convenient vertical relative movement (FIG. 3) and registration (FIG. 4) on assembly, to circumferentially define a continuous alternately sinuous, up and down passageway 40 (FIGS. 4, 6) for sweeping contaminating gases out of the work holder while continually sweeping and covering the work in the protective gas flowing from pipe 31.

The parts to be heat treated may be initially positioned (FIG. 1) in the work holder 10 which in turn is positioned in the outermost member 15. The operator or programmed elevating and lowering means may then lower the inner hood 13 (as by means connected to bracket 37, FIG. 4) downwardly into the work holder 10. The inner hood member 13 rests upon the lower bottom wall 21 of the work holder 10 (FIG. 4). The outer hood 14, under the control of the operator or programming means, is lowered, as by means engaging brackets 34, to a position intermediate the work holder 10 and the outermost member 15. As may be noted from FIG. 4, the parts described are proportioned so that, for example, and without limitation thereto, a practical but relatively narrow space, such as $\frac{1}{8}$ to $\frac{1}{4}$ inch of clearance, is provided between the side walls 25, 26, 27 and 28 of the work holder, inner hood, outer hood, and outermost member 15, defining, when assembled (FIG. 4) the said gas flow passageway 40.

In operation, the apparatus, as above described and shown in FIGS. 3, 4, may initially be moved into alignment with the furnace or other heating means; the apparatus would be initially flushed with a gas such as dry nitrogen or $CO_2$. This may be followed by flushing with hydrogen. When all of the contaminating gases have been flushed out of the apparatus, pure dry hydrogen or dissociated ammonia or a mixture of carburizing gases may be passed through gas supply source 33, and through pipe 31 and through and out of gas discharge passageway 40, wherein the special procedures of this invention are applied to work parts 11 and 12 of ferrous or similar metals and alloys. Where the work parts are made of titanium alloys, the gas passed through the gas supply source 33 may be argon or helium.

As above noted, the gas is pumped to the gas supply source 33 at about 30 pounds per square inch for a gas flow of from 10 to 40 cubic feet per hour, sufficient to maintain the rate of flow of the gas through the gas discharge passageway 40 at such velocity as to repel and discharge all impurities which otherwise would tend to infiltrate into apparatus and onto the work holder and work by diffusion, leakage or otherwise. While the inner hood 13 rests on the work holder 10 (FIG. 4) as above described, in practice, minor variations in the contours of the parts 10, 13, 14, 15 exist, so that sufficient clearance is afforded between the bottom of the inner hood and the bottom wall 21 of the work holder on which it rests. The variations or differences are of advantage in practice of the invention, as they allow flow of the gases through the gas discharge passageway 40 circumferentially at the interface of the lower edge of the inner hood 13 and the bottom wall 21 of the work holder.

This invention has been set forth above in terms of a specific embodiment thereof; however, it is to be understood that variations may be made therein by those skilled in the art which variations may nevertheless be within the scope and spirit of the invention. The invention is therefor to be broadly construed within the scope and spirit of the claims appended hereto.

I claim:

1. An apparatus for cooling heat treated work parts wherein the work contained therein, preheated at a heating station, is then transferred out of the heating station to a station wherein the work is cooled, said cooling apparatus comprising:

(a) a cup-shaped work holder member, positioned in upwardly opening relation in said apparatus;

(b) a cup-shaped inner hood member of smaller proportions than said work holder member, proportioned for positioning therein in downwardly opening telescopic relation in the work holder, (c) a cup-shaped outer hood member of larger proportions than the work holder, positioned in said apparatus in downwardly opening relation telescopically overlying the work holder and the inner hood member, (d) an outermost cup-shaped member of larger proportions than the other previously mentioned members, disposed in said apparatus in upwardly opening relation to and receiving said previously mentioned members therein, (e) said four cup-shaped members being formed of closely interfitting dimensions, (f) said cup-shaped members being positioned, on assembly, telescopically in alternately upwardly and downwardly opening relation, defining a continuous sinuous gas passageway therebetween, unobstructed and uninterrupted, and (g) means moving a gas under pressure into the work holder and over the work therein and thence unidirectionally through the continuous gas passageway defined by said so registered cup-shaped members and discharged therefrom, sweeping and discharging contaminating gases from said apparatus, into the ambient atmosphere.

2. In an apparatus for heat treating work parts as set forth in claim 1:

said work holder, inner hood, outer hood and outermost member being of circular form and being each formed with a side wall and connected bottom portion, and defining therebetween a continuous unidirectional gas discharge passageway for said gas so moved therethrough.

3. An apparatus for heat treatment, at a cooling station, of metallic and alloy work parts which have been preheated, at a heating station, and then transferred therefrom to said cooling station, comprising:

(a) an upwardly opening, cup-shaped work holder member, receiving said work parts therein, (b) an outermost, upwardly opening cup-shaped member, of larger proportions than the work holder, receiving the work holder therein, (c) an inner cup-shaped hood member, of smaller proportions than the work holder and positioned therein in downwardly opening relation, (d) an outer, downwardly opening, cup-shaped hood member positioned intermediate the work holder and the outermost, upwardly opening cup-shaped member, (e) said inner hood, work holder, outer hood and outermost member, being proportioned of progressively greater dimensions to telescopically and readily movably interfit on registration and define therebetween a continuous unidirectional gas flow passageway, and (f) means moving work-sweeping gas under pressure into the inner hood and work holder and out therefrom, and over the work therein and thence unidirectionally through the continuous gas passageway defined by said so registered members defining therebetween a continuous gas flow passageway and discharged therefrom into the ambient atmosphere, maintaining the parts clean of contaminating air and gases.

4. In an apparatus for heat treating work parts as set forth in claim 3:

means connecting the gas supply source to the inner hood, said connecting means so providing a source of flow of gas under pressure into the innermost of said cup-shaped members and onto the work and thence between said members and outwardly in the gas flow passageway so defined therebetween, all of said described members being cup-shaped and so interfitting in continuous and unobstructed alternately upwardly and downwardly opening relation, thereby defining a continuous and unobstructed gas flow passageway therebetween and therethrough.

* * * * *